US005270506A

United States Patent [19]

Masoner

[11] Patent Number: 5,270,506

[45] Date of Patent: Dec. 14, 1993

[54] SNAP ACTION SWITCH

[75] Inventor: Garold W. Masoner, St. Charles, Minn.

[73] Assignee: Lake Center Industries, Inc., Winona, Minn.

[21] Appl. No.: 737,684

[22] Filed: Jul. 30, 1991

[51] Int. Cl.[5] ..... H01H 5/00

[52] U.S. Cl. ..... 200/468; 200/559; 200/283

[58] Field of Search ..... 200/459, 460, 461, 408, 200/468, 559, 553, 283, 335, 407, 332, 303, 405, 406, 409; 267/158, 159

[56] References Cited

U.S. PATENT DOCUMENTS

| | | | |
|---|---|---|---|
| 2,286,053 | 6/1942 | Bletz | 200/460 X |
| 2,700,079 | 1/1955 | Haydon | 200/460 |
| 2,966,559 | 12/1960 | Meyer | 200/559 X |
| 3,120,590 | 2/1964 | Dahlin | 200/460 |
| 3,306,998 | 2/1967 | Russell | 200/407 |
| 3,571,541 | 3/1971 | Bedoes et al. | 200/335 X |
| 3,648,004 | 3/1972 | Williams | 200/332 X |
| 4,336,429 | 6/1982 | Jackson et al. | 200/408 |
| 4,484,042 | 11/1984 | Matsui | 200/406 |
| 4,523,064 | 6/1985 | Rose | 200/303 X |
| 4,943,696 | 7/1990 | Staples | 200/335 X |
| 5,053,592 | 10/1991 | Zuercher | 200/553 |
| 5,113,047 | 5/1992 | Tsutsumi | 200/406 X |

FOREIGN PATENT DOCUMENTS

| | | | |
|---|---|---|---|
| 937712 | 1/1956 | Fed. Rep. of Germany | 200/406 |

*Primary Examiner*—Henry J. Recla
*Assistant Examiner*—Glenn T. Barrett
*Attorney, Agent, or Firm*—Kinzer, Plyer, Dorn, McEachran & Jambor

[57] ABSTRACT

A snap action switch has a base and cover enclosing upper and lower electrical terminals. A spring blade disposed between the terminals is movable by a cover-mounted actuator between engagement with one terminal or the other. The spring blade has only one stable position to which it returns upon release of the actuator force. The spring blade includes an anchor mounting the blade in the base and defining a generally planar junction portion. A pair of wings extend out of the plane of the junction portion. An elongated center beam connects at a fixed end to the junction. Outer beams on either side of the center beam connect to the wings. The free ends of all three beams are joined at a contact portion. Crimps in the outer beams place them in tension and the center beam in compression.

9 Claims, 2 Drawing Sheets

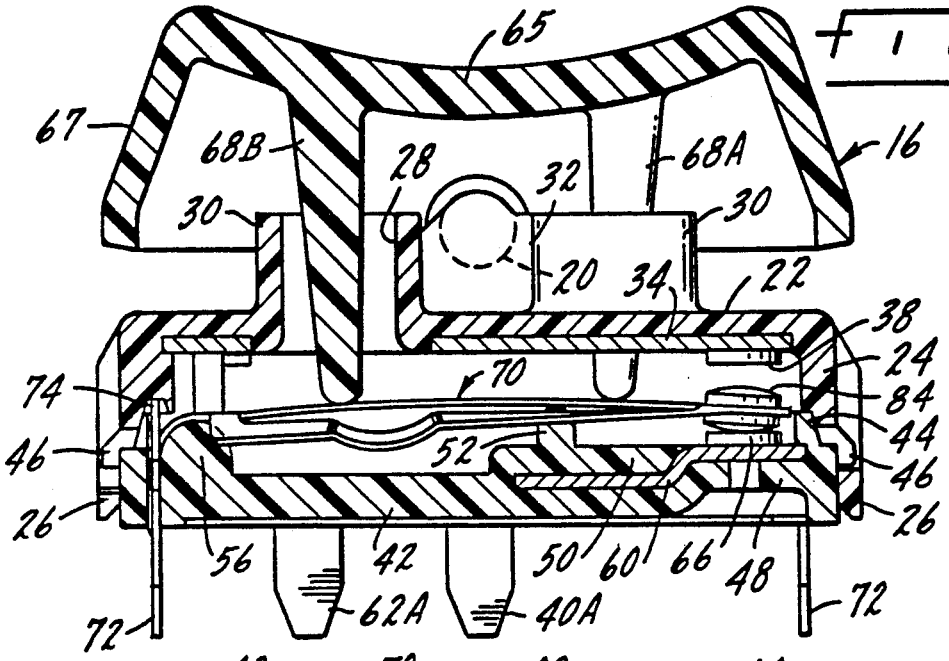
Fig.7.
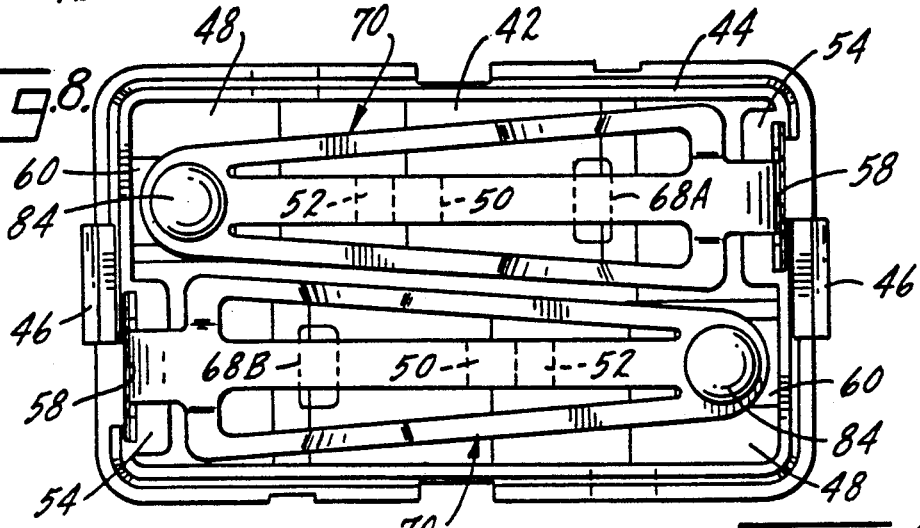
Fig.8.
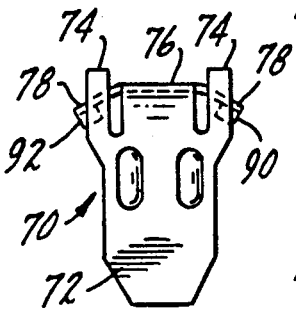
Fig.11.
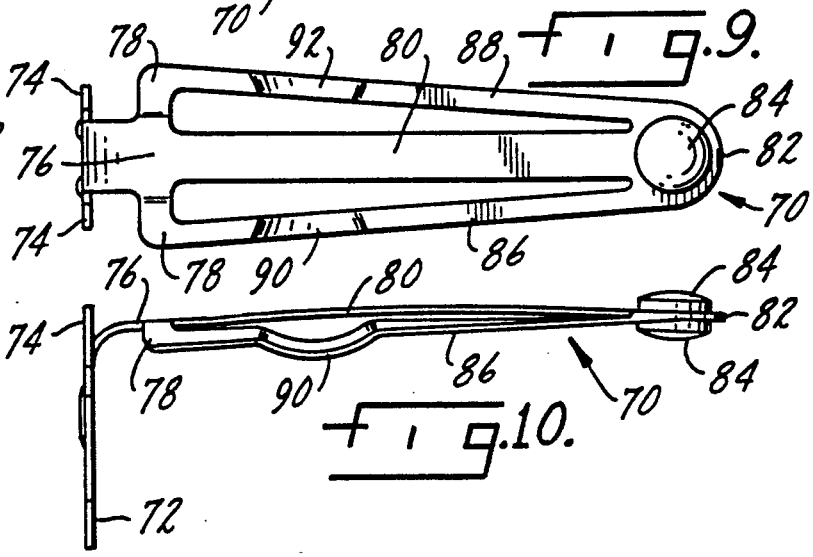
Fig.9.
Fig.10.

SNAP ACTION SWITCH

BACKGROUND OF THE INVENTION

This invention relates to snap action electrical switches. It is particularly concerned with a snap action switch capable of carrying currents loads on the order of 20 amps or so. Switches having this current capacity require a minimum contact force of about 100 grams to ensure a low resistance contact interface. They also require a minimum air gap between contacts of about 1 millimeter to prevent arcing. Given these parameters, making a reliable snap action switch having high current capacity, low resistance, small size and long life becomes a difficult undertaking as satisfaction of one criterion conflicts with meeting the next.

One aspect of prior art snap action switches is the use of a spring blade having two stable or rest positions. These blades are made of flat, resilient material. They have an elongated central compression member and two elongated tension members on either side of the compression member. The three elongated members have their ends joined at unitary contact pads. The tensions members impart a curved or bowed configuration to the compression member. When a user actuates the switch a plunger or the like acts on the blade, eventually moving the compression member through the center of its bowed shape, whereupon the blade snaps to a thrown position. Having been moved over center, the blade assumes a second stable or rest position. Thereafter, returning the switch to its initial condition requires application of force to move the spring blade back through center to its first stable position. Provision of a mechanism to effect this returning force complicates the switch design, thereby raising its cost.

The complications of a return mechanism can be avoided by not allowing the spring blade to snap all the way over center. In other words, if the size and spacing of the switch parts are carefully controlled, the spring blade can be arranged to snap to a thrown position without moving through center. Then when the actuating force is removed the blade returns on its own to its initial condition. This approach is used in prior art switches such as Rose, U.S. Pat. No. 4,523,064.

The spring blades in these prior switches still have two stable positions but the switch housings are designed to constrain the blade from ever moving far enough to reach the second stable position. The problem with restricting the spring blade travel to prevent over-centering is a marked increase in the number of critical dimensions to assure proper functioning of the switch. That is, the shape and mechanical properties of the blade must be carefully controlled. The base in which the blade is mounted must support it precisely, the fulcrum has to be located exactly, the actuator must consistently impinge at the right place, and so on throughout the structure. Holding these tolerances becomes as much trouble as providing a return force for an over-centered blade. The switch of the present invention overcomes these problems with a spring blade that has only one stable position.

SUMMARY OF THE INVENTION

The present invention concerns a snap action electrical switch. A primary object of the invention is a snap action switch having a spring blade that has only one stable position.

Another object of the invention is a snap action switch that is fast acting, with the speed of actuation independent of the rate at which the user applies force to the switch.

Another object of the invention is a switch of the type described having greater contact force and less critical dimensional requirements than previous switches.

A further object is a snap action switch of compact size that is capable of carrying relatively high current loads.

Yet another object of the invention is a snap action switch having a long life.

These and other objects which may become apparent are achieved by a snap action switch having a housing including a base, a cover attached to the base and an actuator pivotally mounted on the cover. Upper and lower electrical terminals are molded in the cover and base respectively. A spring blade has an anchor mounted in the base and including a junction portion. A pair of wings extend out of the plane of the junction portion. Elongated outer beams connect to the wings and extend to a contact portion. An elongated center beam extends between the junction and contact portions, between the outer beams. Crimps in the outer beams place them in tension and the center beam in compression. The center beam has a bowed shape that defines a chord between the beam's ends. The connection of the outer beams to the wings places them on the opposite side of the chord from the center beam.

With this configuration of the outer beams, the spring blade has only one stable position. When the user presses on the actuator, it motivates the center beam to snap from engagement with one terminal to the other but upon release of the actuator the beam snaps back to its original condition. This occurs regardless of the amount of travel of the center beam.

BRIEF DESCRIPTION OF THE DRAWINGS

FIG. 7 is a section, on an enlarged scale, through the switch.

FIG. 8 is a plan view of the base, with the cover removed to show the spring blades in place.

FIG. 9 is a top plan view of one of the spring blades.

FIG. 10 is a side elevation view of the spring blade.

FIG. 11 is an end elevation view of the spring blade.

DETAILED DESCRIPTION OF THE INVENTION

Figure 1:
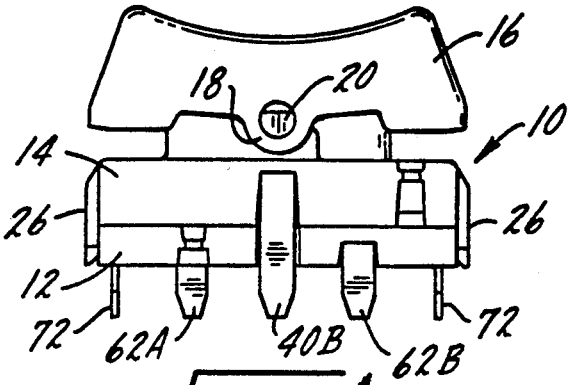
FIG. 1 is a side elevation view of the snap action switch according to this invention.
Figure 2:
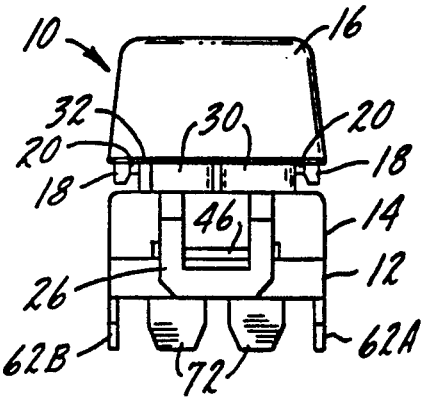
FIG. 2 is an end elevation view of the snap action switch.

The snap action switch of the present invention is shown generally at 10 in FIGS. 1 and 2. A hollow switch housing is defined by a base member 12 and a cover 14. An actuator 16 is pivotally mounted on the cover 14 by means of stirrups 18. The stirrups define openings which receive stub shafts 20 formed on the upper portion of the cover. Posts or legs of electrical terminals are visible in FIGS. 1 and 2, extending from the cover and base. These posts will be described below.

Figure 3:
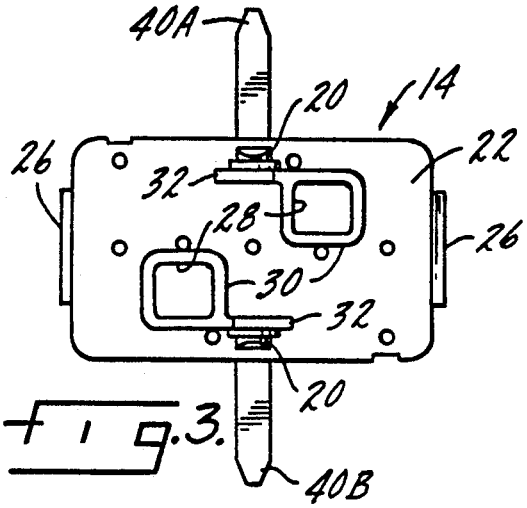
FIG. 3 is a top plan view of the cover, with the actuator removed.
Figure 4:
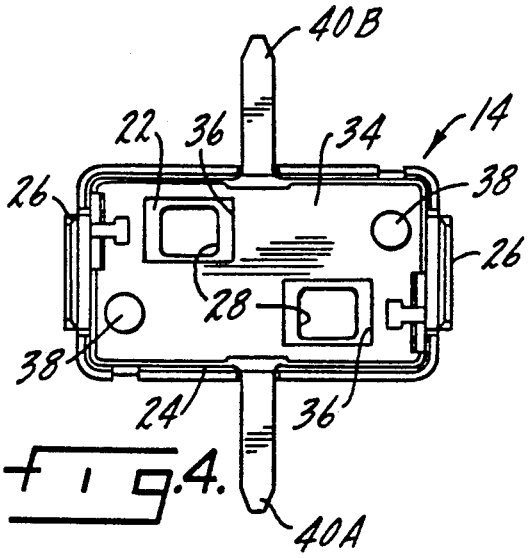
FIG. 4 is a bottom plan view of the cover.

Details of the cover 14 are shown in FIGS. 3 and 4. The cover has a generally rectangular plate 22 which forms the top surface of the housing. A depending wall 24 extends around the periphery of the plate 22. U-shaped latches 26 (best seen in FIG. 2) are formed on the ends of the wall 24. The plate 22 has a pair of square openings 28 extending therethrough. The openings are surrounded by upstanding enclosures 30 on the upper surface of the plate 22. These enclosures have extensions 32 which support the stub shafts 20.

The underside of the plate 22 has an upper electrical terminal 34 molded therein. As seen in FIG. 4, the upper terminal 34 covers a substantial portion of the underside of plate 22. The terminal has apertures 36 surrounding the holes 28. The terminal also has contact pads 38. The upper terminal 34 further includes a pair of depending legs or posts 40A, 40B. These are shown in FIGS. 3 and 4 in their flat, as-molded condition. In FIGS. 1 and 2 they are shown folded down 90° so that they extend in a vertical plane.

Figure 5:
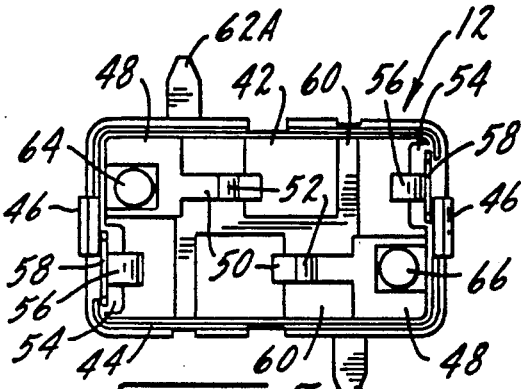
FIG. 5 is a top plan view of the base section of the snap action switch, with the cover and spring blades removed.
Figure 6:
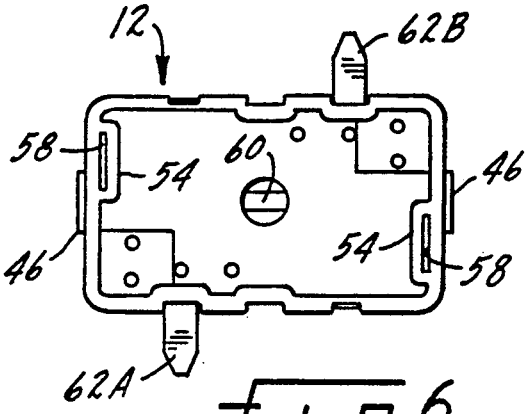
FIG. 6 is a bottom plan view of the base section of the snap action switch.

Looking now at FIGS. 5 and 6, it can be seen that the base 12 has a case-like construction similar to the cover in that the base has a rectangular plate or floor 42 surrounded by an upstanding wall 44. The ends of the wall 44 carry hooks 46. The hooks are engageable with the latches 26 to retain the cover on the base, with upper wall 24 resting on the lower wall 44. The interior of the enclosure formed by the floor 42 and walls 44 includes two pedestals 48 in diagonally opposite corners. Ledges 50 extend from the pedestal toward the center of the floor. Fulcrums 52 protrude upwardly from the ledges 50. In the corners opposite the two pedestals are partitions 54 which include enlargements with rounded shoulders 56. Between the partitions 54 and outer wall 44 there is a slot 58 which extends through the base.

A lower electrical terminal 60 is molded into the base plate 42. Legs or posts 62A, 62B extend from the side walls, similar to the legs 40. The lower terminal includes contact pads 64 and 66 which are exposed on top of the pedestals 48. Although it has two contact pads and two posts, the parts of the lower terminal 60 are all electrically connected so as to form a single electrical connecting point. This is also the case with the upper terminal 34. If required by a given switching application the two contact pads and terminals can be electrically isolated.

Details of the actuator 16 are shown in FIG. 7. The actuator is a cap-like structure having a curved upper surface 65 and a surrounding skirt 67. The stirrups are integrally formed in the lower side edges of the skirt. A pair of plungers 68A, 68B are molded on the underside of surface 65. The plungers 68 extend through the enclosures 30 into contact with a spring blade 70. As shown in FIG. 8, there are two spring blades mounted in the base 12. The spring blades are identical.

Details of one of the spring blades are shown in FIGS. 9–11. Each spring blade includes an anchor portion having a vertical mounting tab 72 with a pair of upstanding tangs 74. The mounting tab 72 extends through the slots 58 in the base. The top of the mounting tab 72 curves over the shoulder 56, as best seen in FIG. 7, and extends to a generally planar junction portion 76. The anchor further includes two wings 78 which extend from the junction portion 76. An important feature of the spring blade construction is that the wings 78 extend downwardly out of the plane of the junction portion. This is best seen in FIGS. 10 and 11.

The spring blade 70 further includes an elongated center beam 80 which is connected at one end to the junction portion 76. The center beam extends to a contact portion 82 at the free or cantilevered end of the spring blade. The contact portion 82 contains or carries a pad 84.

Outer beams 86 and 88 are connected at one end to one of the wings 78 and at the other end to the contact portion 82. The outer beams are crimped at 90 and 92, thereby placing the outer beams in tension and the center beam in compression. The tension of the outer beams imparts a bowed configuration to the center beam 80, as best seen in FIGS. 7 and 10. The bowed configuration defines a chord between the ends of the center beam, that is, the points where the center beam joins the junction portion 76 and the round contact portion 82. With the wings 78 deflected downwardly from the junction portion 76, the outer beams 86, 88 are disposed on the opposite side of this chord from the center beam 80. In other words, the chord is offset from the both the center and outer beams. The chord is between the outer beams and the center beam. With this geometry the spring blade has only one stable condition. This contrasts with prior art constructions wherein the outer beams coincide with the chord of the bowed center beam, resulting in two stable positions for the blade.

FIG. 7 illustrates the complete assembly of the snap action switch. As explained above, the mounting tabs 72 of spring blades 70 are pressed into the slots 58 in the base. In the rest or normal position, the contact pads 84 of the spring blades rest on the pads 64, 66 of the lower terminal 60. This forms an electrical circuit between the mounting tab 72 and the lower terminal 60 and its posts 62. Intermediate its ends the center beams 80 are supported by the fulcrums 52. The spring blades are enclosed by the cover 14 which overlies the base 12 and is held thereon by engagement of the hooks 46 and latches 26. The actuator plungers 68 engage the bowed center beams 80, as indicated in FIGS. 7 and 8.

When a user pushes the cap portion of the actuator, the actuator rotates on stub shafts 20, causing the plunger 68 to press down on the center beam 80 of the associated spring blade 70. Eventually the force pushes the center beam through center. The free end portion of the blade snaps up bringing contact pad 84 into engagement with the upper terminal pad 38. This forms an electrical circuit from the spring blade to the upper terminal and its posts 40. However, in this condition the center beam 80 is not depressed far enough to push it past the position of the outer beams 86, 88. That is, since the wings 78 are bent downwardly, the restoring force of the outer beams still tends to return the center beam to its normal or rest position, as shown in FIGS. 7 and 8. Thus, the only thing holding the center beam in the raised or thrown position is the force of the actuator's plunger. Once that is released, the spring blade snaps back to its original condition. Again, this is due to the configuration of the wings and the resulting force applied by the tension in the outer beams. It is not dependent on the gap between the pad 84 and pad 38 and, therefore, the dimensions of the base and cover are less critical than in previous switches.

Whereas a preferred form of the invention has been shown and described, it will be realized that alterations and modifications may be made thereto without departing from the scope of the following claims.

I claim:

1. A spring blade for a snap action switch, comprising:

an anchor including a generally planar junction portion with first and second wings connected thereto and extending out of the plane of the junction portion;

an elongated center beam connected at one end to the junction portion;

a contact portion adjoining the other end of the center beam;

first and second outer beams each connected at one end to one of said wings and at the other end to the contact portion, the outer beams each having a crimp formed therein to give the beams an effective length shorter than the center beam, thereby imparting a bowed configuration to the center beam, the bowed center beam being concave only on one side and convex only on the other side, with the outer beams being disposed entirely on the concave side of the center beam.

2. The spring blade of claim 1 wherein the anchor further comprises a mounting tab connected to the junction portion and extending perpendicular thereto.

3. The spring blade of claim 1 further comprising a contactor pad mounted in the contact portion.

4. The spring blade of claim 1 wherein the wings extend downwardly from the junction portion.

5. A spring blade for a snap action switch having only one stable position, comprising an anchor and a contact portion at opposite ends of the blade, an elongated center beam extending between the anchor and contact portion, first and second elongated outer beams located on each side of the center beam and extending between the anchor and the contact portion, the outer beams each having en effective length shorter than the center beam, thereby imparting a bowed configuration to the center beam, said bowed configuration defining a chord between the ends of the center beam, the anchor and contact portion being shaped such that the outer beams connect to the anchor at a point below the chord, and extend entirely on the side of the chord opposite the center beam.

6. The structure of claim 5 wherein the anchor includes a generally planar junction portion with first and second wings connected thereto and extending out of the plane of the junction portion.

7. A snap action switch, comprising:

a base having a lower electrical terminal therein;

a cover having an upper electrical terminal therein;

a spring blade having only one stable position, the spring blade including an elongated center beam, a contact portion formed at one end of the center beam and normally in engagement with the lower electrical contact, an anchor portion at the other end of the center beam, the center beam having a bowed configuration imparted by first and second elongated outer beams located on each side of the center beam, said bowed configuration defining a chord between the ends of the center beam, the outer beams being arranged such that they connect to the anchor at a point below the chord, and extend entirely on the side of the chord opposite the center beam; and an actuator pivotably mounted on the cover and engageable with the spring blade to bias the contact portion into engagement with said upper electrical terminal.

8. The switch of claim 7 wherein the spring blade includes an anchor comprising a generally planar junction portion with first and second wings connected thereto and extending out of the plane of the junction portion, the outer beams being connected at one end to the wings and the center beam being connected at one end to the junction portion.

9. The switch of claim 7 wherein two spring blades are mounted in the base and the actuator engages one of them when thrown one direction and the actuator engages the other spring blade when the actuator is thrown the other direction.

* * * * *